United States Patent [19]

Jaros

[11] 4,194,773

[45] Mar. 25, 1980

[54] LATCHING DEVICE

[76] Inventor: Philip W. Jaros, R.D. #1, Gloversville, N.Y. 12078

[21] Appl. No.: 871,945

[22] Filed: Jan. 24, 1978

[51] Int. Cl.[2] ..... E05C 17/18

[52] U.S. Cl. ..... 292/267; 70/DIG. 12

[58] Field of Search ..... 292/270, 266, 269, 274, 292/278, 265, 267, 268; 49/72; 70/DIG. 12

[56] References Cited

U.S. PATENT DOCUMENTS 3,093,846 6/1963 Reid ..... 292/266 X

FOREIGN PATENT DOCUMENTS 21892 of 1929 Australia ..... 292/269
154 of 1896 United Kingdom ..... 292/267
3025 of 1903 United Kingdom ..... 292/267

*Primary Examiner*—J. Franklin Foss
*Attorney, Agent, or Firm*—Joseph P. Flanagan

[57] ABSTRACT

The invention comprises an improved latching device for latching a vent assembly in open or closed position and includes means secured to the vent, and a fixed element with a movable locking element for, selectively moving the vent from a closed position to various open positions and locking same in place.

3 Claims, 5 Drawing Figures

LATCHING DEVICE

The present invention relates to latching devices and more particularly to a latching device which may be used, for example, to latch a vent member on a boat cockpit in a closed position or any one of a number of open positions.

The primary object of the invention is the provision of a latching device having an improved construction to securely lock a vent member in an open or closed position and which assembly is simple in construction and operation and occupies a relatively limited amount of space.

The above and further objects, and the entire scope of applicability of the present invention will become apparent from the detailed description and drawings hereinafter provided. It should be understood, however, that the instant detailed description and drawings are given by way of illustration only and, while indicating a preferred embodiment of the invention, are not given by way of limitation, since various changes and modifications within the spirit and scope of the invention will become apparent to those skilled in the art from such detailed description, when taken in conjuction with the drawings wherein:

Figure 1:
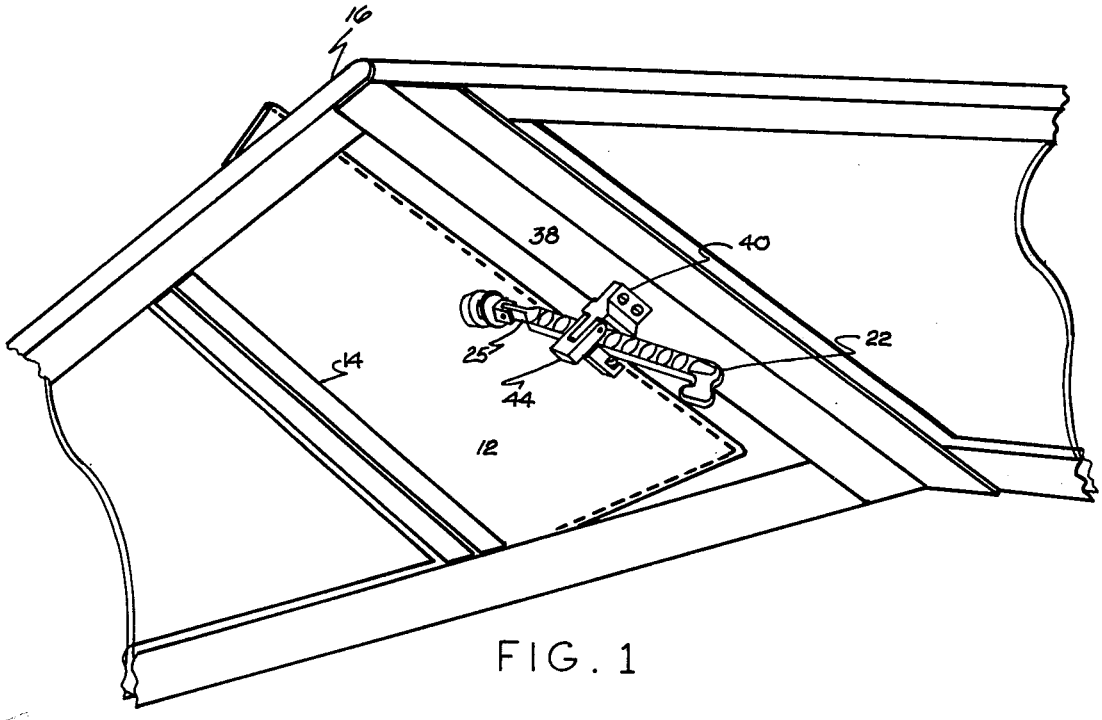
FIG. 1 is a perspective view of the vent assembly equipped with the latching device of the instant invention.
Figure 2:
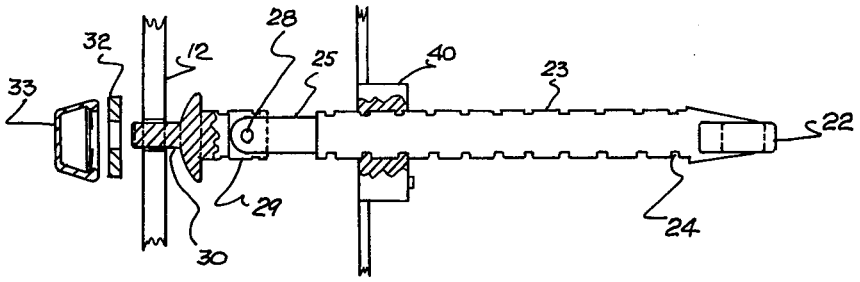
FIG. 2 is a section view of a portion of the structure of FIG. 1.
Figure 3:
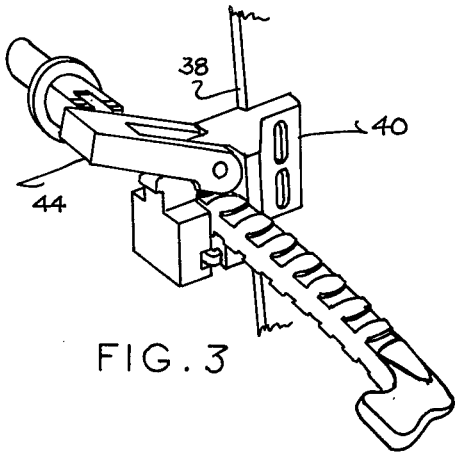
FIG. 3 is a perspective view of a portion of the structure of FIG. 1.

A vent member 12 is suitably connected by any appropriate hinge member 14 to a windsheild frame assembly 16.

A latch member having a handle portion 22, a central portion with a series of lands 23 and grooves 24, and a connector portion 25 is pivotally connected to the vent member 12 by means of a pin 28 and bracket 29 assembly carried on a connecting member 30. The connecting member 30 extends through the vent member 12 and is secured in place by a washer 32 and nut 33 assembly.

Secured to a supporting post 38 of the windsheild frame assembly is a guiding and locking assembly 40.

The assembly 40 may be secured to the windsheild frame assembly by any suitable securing means and is provided with a passageway for movement of the latching member therethrough. Further, the guiding and locking assembly 40 is provided with a pivotal locking member 44. The locking member 44 is provided with protuberant structure 47 which cooperates in a manner hereinafter described with the land and groove structure on the member.

Figure 4:
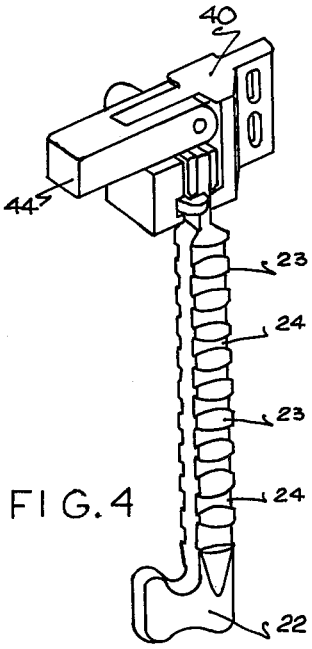
FIG. 4 is a perspective view of a portion of the structure of FIG. 1.
Figure 5:
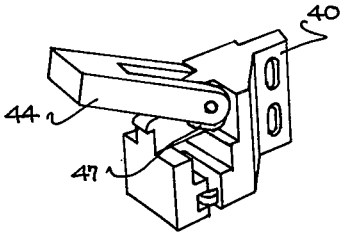
FIG. 5 is a perspective view of a portion of the structure of FIG. 1.

When it is desired to open the vent member 12, the locking member 44 would be rotated clockwise, FIG. 4, and the handle 22 of the locking member would be rotated from its vertical position of FIG. 4 to a horizontal position. The locking member would then be pushed through the guiding structure of the guiding and locking assembly 40 to the extent desired whereupon the latching member 44 would be rotated counterclockwise to cooperate with the land and groove structure to lock the vent in open position, FIG. 1. To close the vent, the procedure is reversed.

Thus, although in the instant disclosure I have shown a preferred embodiment of my invention, a range of alteration, modification, change, and substitution is intended therein and in some instances some features of the invention will be utilized without a corresponding use of other features. Accordingly, it is intended that the claims be construed in a manner consistent with the full range of the spirit and scope of the invention herein.

Having thus described my invention, I claim:

1. A latching device for releasably securing a vent member in a plurality of positions, said latching device comprising a connecting member secured to a vent member, said vent member being carried on a frame means, a latch bar pivotally attached to said connecting member, a guiding and locking assembly attached to said frame means, said guiding and locking assembly having an aperture formed therein for slidably receiving said latch bar and lock means pivotally mounted on said guiding and locking assembly for securing said latching member, said latch bar constructed and arranged for movement in directions axially and non-axially relative to one axis of said aperture.

2. The invention of claim 1, wherein said latch bar has a series of lands and grooves for cooperation with said lock means.

3. The invention of claim 2 wherein said lock means is formed with a protuberance thereon for engagement with said latch bar.

* * * * *